US009885274B2

(12) United States Patent
Sato

(10) Patent No.: US 9,885,274 B2
(45) Date of Patent: Feb. 6, 2018

(54) OIL JET SYSTEM FOR INTERNAL COMBUSTION ENGINE, AND CONTROL METHOD FOR OIL JET SYSTEM

(71) Applicant: TOYOTA JIDOSHA KABUSHIKI KAISHA, Toyota-shi, Aichi-ken (JP)

(72) Inventor: Akihiro Sato, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 52 days.

(21) Appl. No.: 15/025,369

(22) PCT Filed: Sep. 30, 2014

(86) PCT No.: PCT/IB2014/001962
§ 371 (c)(1),
(2) Date: Mar. 28, 2016

(87) PCT Pub. No.: WO2015/049569
PCT Pub. Date: Apr. 9, 2015

(65) Prior Publication Data

US 2016/0237877 A1 Aug. 18, 2016

(30) Foreign Application Priority Data

Oct. 4, 2013 (JP) ..... 2013-209253

(51) Int. Cl.

| | |
|---|---|
| ***F01P 3/08*** | (2006.01) |
| ***F01M 1/08*** | (2006.01) |
| ***F01M 1/16*** | (2006.01) |
| ***F01P 7/16*** | (2006.01) |

(52) U.S. Cl.
CPC ..... *F01P 3/08* (2013.01); *F01M 1/08* (2013.01); *F01M 1/16* (2013.01); *F01P 7/16* (2013.01)

(58) Field of Classification Search
CPC ..... F01P 3/08; F01P 7/16; F01M 1/08; F01M 1/16
See application file for complete search history.

(56) References Cited

U.S. PATENT DOCUMENTS

| | | | | |
|---|---|---|---|---|
| 4,667,630 | A | 5/1987 | Sasaki | |
| 8,977,477 | B2 * | 3/2015 | Maki | F01M 1/08 123/41.34 |

FOREIGN PATENT DOCUMENTS

| | | | |
|---|---|---|---|
| JP | S61-138816 | A | 6/1986 |
| JP | H08-151916 | A | 6/1996 |
| JP | 2003-097269 | A | 4/2003 |
| JP | 2009-144540 | A | 7/2009 |
| JP | 2009-228574 | A | 10/2009 |
| JP | 2010-236438 | A | 10/2010 |

* cited by examiner

*Primary Examiner* — Hung Q Nguyen
(74) *Attorney, Agent, or Firm* — Oliff PLC

(57) ABSTRACT

In an oil jet system that directs an oil jet toward a back face of a piston, when a coolant temperature of an engine has increased to a predetermined temperature in a stopped state of the oil jet, the piston is cooled by starting the oil jet. When a lubricating oil temperature of the engine has decreased to a predetermined temperature in an operated state of the oil jet, a delay time is determined based on a variation amount in engine rotation speed and a variation amount in intake air filling factor during a predetermined period, and the oil jet is stopped after a lapse of the delay time.

16 Claims, 8 Drawing Sheets

OIL JET SYSTEM FOR INTERNAL COMBUSTION ENGINE, AND CONTROL METHOD FOR OIL JET SYSTEM

BACKGROUND OF THE INVENTION

1. Field of the Invention

The invention relates to an oil jet system that injects oil toward a piston of an internal combustion engine, and a control method for the oil jet system. Particularly, the invention relates to measures for optimizing the timing of switching between an operated state and stopped state of an oil jet.

2. Description of Related Art

As is described in, for example, Japanese Patent Application Publication No. 61-138816 (JP 61-138816 A) and Japanese Patent Application Publication No. 2010-236438 (JP 2010-236438 A), there is known an engine including an oil jet system that injects engine oil (lubricating oil) (directs an oil jet) toward the back face side of a piston. By cooling the piston with the oil jet, it is possible to suppress an excessive increase in the temperature of the piston.

As control over the oil jet, JP 61-138816 A describes that an oil jet is started when the temperature of the engine oil becomes higher than or equal to a predetermined value, and the amount of oil jet at that time is calculated on the basis of an engine rotation speed and a fuel injection amount.

JP 2010-236438 A describes that an oil jet is stopped when the temperature of coolant of the engine becomes lower than or equal to a predetermined value.

SUMMARY OF THE INVENTION

Incidentally, if the timing of switching between an operated state and stopped state of an oil jet (the timing of switching from the stopped state to the operated state (hereinafter, referred to as "oil jet start timing") and the timing of switching from the operated state to the stopped state (hereinafter, referred to as "oil jet stop timing")) is not appropriately obtained, there is a possibility that the following inconvenience arises.

The case where the oil jet stop timing is not appropriately obtained will be described as an example. Initially, when the oil jet stop timing is late and, as a result, an oil jet operation period is long, engine oil is easy to flow into a combustion chamber (oil is easy to leak into the combustion chamber) via the clearance between a cylinder inner wall surface (bore wall surface) and a piston. In this way, when there occurs a leakage of oil into the combustion chamber, the consumption of engine oil increases. Moreover, there is a concern that the engine oil forms a deposit (carbon deposit is produced because of carbonization of oil sludge) on the cylinder inner wall surface or the piston top face. This deposit causes pre-ignition (phenomenon that air-fuel mixture is ignited before intended ignition timing) at the time when the cylinder inner wall surface or the piston top face has reached a predetermined temperature or higher while the engine is operating at a low rotation high load. Hereinafter, this pre-ignition is termed low speed pre-ignition (LSPI).

When the oil jet stop timing is early and, as a result, the oil jet operation period is short, it is not possible to sufficiently cool the piston, so there is a possibility that an excessive increase in the temperature of the piston arises.

In the configuration that stars an oil jet at the timing at which the temperature of the engine oil becomes higher than or equal to the predetermined value as described in JP 61-138816 A, there is a possibility that the oil jet start timing is not appropriately obtained, with the result that there is a possibility that the piston is cooled more than necessary (when the oil jet start timing is early) or an excessive increase in the temperature of the piston arises (when the oil jet start timing is late).

Considering that the timing of switching between an operated state and stopped state of an oil jet is appropriately obtained, the inventor of the invention studied parameters for determining the oil jet start timing and the oil jet stop timing.

The invention provides an oil jet system for an internal combustion engine, which is able to appropriately obtain the timing of switching between an operated state and stopped state of an oil jet, and a control method for the oil jet system.

In an aspect of the invention, the timing of switching the oil jet from the stopped state to the operated state is set on the basis of a temperature that highly correlates with a temperature of a piston in the stopped state of the oil jet (specifically, a coolant temperature of the internal combustion engine). The timing of switching the oil jet from the operated state to the stopped state is set on the basis of a temperature that highly correlates with a temperature of the piston in the operated state of the oil jet (specifically, a lubricating oil temperature of the internal combustion engine).

Specifically, a first aspect of the invention provides an oil jet system for an internal combustion engine. The oil jet system includes an oil jet mechanism and an ECU. The oil jet mechanism is configured to direct an oil jet toward a piston of the internal combustion engine. The ECU is configured to: (a) control the oil jet between an operated state and a stopped state; (b) in the stopped state of the oil jet, control timing of an oil jet start operation on the basis of a coolant temperature of the internal combustion engine; and (c) in the operated state of the oil jet, control timing of an oil jet stop operation on the basis of a lubricating oil temperature of the internal combustion engine.

As a relationship between each temperature and an operation to switch between the operated state and stopped state of the oil jet, specifically, the ECU may be configured to, in the stopped state of the oil jet, execute the oil jet start operation at the time when the coolant temperature of the internal combustion engine has increased to a predetermined temperature, and the ECU may be configured to, in the operated state of the oil jet, execute the oil jet stop operation at the time when the lubricating oil temperature of the internal combustion engine has decreased to a predetermined temperature.

The temperature of the piston that is a cooled target of the oil jet highly correlates with the coolant temperature of the internal combustion engine in the stopped state of the oil jet, and highly correlates with the lubricating oil temperature of the internal combustion engine in the operated state of the oil jet. In consideration of this point, in this aspect, the timing of executing the oil jet start operation is controlled on the basis of the coolant temperature in the stopped state of the oil jet, and the timing of executing the oil jet stop operation is controlled on the basis of the lubricating oil temperature in the operated state of the oil jet. Therefore, it is possible to determine the oil jet start timing and the oil jet stop timing that are suitable for an actual temperature of the piston, so it is possible to prevent inconveniences (occurrence of the LSPI, an excessive increase in the temperature of the piston, and the like) due to inappropriate oil jet start timing or inappropriate oil jet stop timing.

The phrase "executing the oil jet start operation at the time when the coolant temperature of the internal combustion engine has increased to a predetermined temperature" means a concept including not only the case where the oil jet is started at the timing at which the coolant temperature has increased to the predetermined temperature but also executing control for starting the oil jet from the timing at which the coolant temperature has increased to the predetermined temperature (for example, an operation to determine a delay time (described later), or the like). Similarly, the phrase "executing the oil jet stop operation at the time when the lubricating oil temperature of the internal combustion engine has decreased to a predetermined temperature" means a concept including not only the case where the oil jet is stopped at the timing at which the lubricating oil temperature has decreased to the predetermined temperature but also executing control for stopping the oil jet from the timing at which the lubricating oil temperature has decreased to the predetermined temperature (for example, an operation to determine a delay time (described later), or the like).

The ECU may be configured to set oil jet stop timing in executing the oil jet stop operation in accordance with an estimated temperature of the piston.

This is to estimate an actual temperature of the piston on the basis of the lubricating oil temperature of the internal combustion engine and control the timing of executing the oil jet stop operation on the basis of the temperature of the piston. Thus, the accuracy of estimating the temperature of the piston is increased, so it is possible to further appropriately set the oil jet stop timing.

Specifically, the ECU may be configured to, in the oil jet stop operation, determine a delay time of oil jet stop timing in response to a rotation speed of the internal combustion engine and an intake air filling factor. More specifically, the ECU may be configured to, when the lubricating oil temperature of the internal combustion engine has decreased to a predetermined temperature, set the delay time of the oil jet stop timing such that the delay time of the oil jet stop timing extends as at least one of a variation amount in the rotation speed of the internal combustion engine during a predetermined period or a variation amount in the intake air filling factor during the predetermined period increases.

Even when the lubricating oil temperature of the internal combustion engine has decreased to the predetermined temperature, there is a possibility that an actual temperature of the piston is still high. For example, this is the case where the internal combustion engine shifts from a high rotation high load operation region to a low rotation low load operation region. In this case, even when the lubricating oil temperature of the internal combustion engine has decreased to the predetermined temperature, there is a possibility that an actual temperature of the piston is still high because of the fact that the internal combustion engine is operated at a high rotation high load until just before. At this time, if the oil jet is stopped at the timing at which the lubricating oil temperature of the internal combustion engine has decreased to the predetermined temperature, there is a possibility that the temperature of the piston is kept high. Therefore, in the above aspect, even when the lubricating oil temperature has decreased to the predetermined temperature, but when a variation amount in the rotation speed of the internal combustion engine till then is large or when a variation amount in the intake air filling factor till then is large, it is estimated that the temperature of the piston is high. Therefore, a delay time until the oil jet is stopped is provided. Thus, necessary minimum cooling of the piston is continued. As a variation in the rotation speed of the internal combustion engine increases or as a variation in the intake air filling factor increases, it is estimated that the temperature of the piston is high, so the delay time is set so as to extend.

A plurality of temperatures may be set as a lubricating oil temperature for starting the oil jet stop operation, and the delay time of the oil jet stop timing may be defined in response to a variation amount in the rotation speed of the internal combustion engine and a variation amount in the intake air filling factor for each temperature. The ECU may be configured to, when the lubricating oil temperature has decreased and reached any one of the plurality of set temperatures, set the delay time of the oil jet stop timing in response to all of the reached temperature, the variation amount in the rotation speed of the internal combustion engine and the variation amount in the intake air filling factor. For the same variation amount in the rotation speed of the internal combustion engine and the same variation amount in the intake air filling factor, a relationship between the plurality of set temperatures and the delay time of the oil jet stop timing may be set such that the delay time of the oil jet stop timing extends as the temperature increases.

This is because it is estimated that the temperature of the piston increases as the lubricating oil temperature increases for the same variation amount in the rotation speed of the internal combustion engine and the same variation amount in the intake air filling factor. Therefore, this is to reliably reduce the temperature of the piston by setting the delay time such that the delay time extends as the lubricating oil temperature increases.

Specifically, the ECU may be configured to, in the oil jet start operation, determine a delay time of the oil jet start timing in response to a rotation speed of the internal combustion engine and an intake air filling factor. More specifically, the ECU may be configured to, when the coolant temperature of the internal combustion engine has increased to a predetermined temperature, set the delay time of the oil jet start timing such that the delay time of the oil jet start timing extends as at least one of a variation amount in the rotation speed of the internal combustion engine during a predetermined period or a variation amount in the intake air filling factor during the predetermined temperature increases.

Even when the coolant temperature of the internal combustion engine has increased to the predetermined temperature, there is a possibility that an actual temperature of the piston is still low. For example, this is the case where the internal combustion engine shifts into the high rotation high load operation region during warm-up operation of the internal combustion engine. In this case, even when the coolant temperature of the internal combustion engine has increased to the predetermined temperature, there is a possibility that an actual temperature of the piston is still low because of the fact that the internal combustion engine is operated at a low rotation low load until just before. At this time, if the oil jet is started at the timing at which the coolant temperature of the internal combustion engine has increased to the predetermined temperature, there is a possibility that the piston is cooled more than necessary. Therefore, in the above aspect, even when the coolant temperature has increased to the predetermined temperature, but when a variation amount in the rotation speed of the internal combustion engine till then is large or when a variation amount in the intake air filling factor till then is large, it is estimated that the piston temperature is still low. Therefore, a delay time until the oil jet is started is provided. Thus, the piston is not cooled more than necessary. As a variation in the rotation speed of the internal combustion engine increases or as a variation in the intake air filling factor increases, it is estimated that the temperature of the piston is low, so the delay time is set so as to extend.

A plurality of temperatures may be set as a coolant temperature for starting the oil jet start operation, and the delay time of the oil jet start timing may be defined in response to a variation amount in the rotation speed of the internal combustion engine and a variation amount in the intake air filling factor for each temperature. The ECU may be configured to, when the coolant temperature has increased and reached any one of the plurality of set temperatures, set the delay time of the oil jet start timing in response to all of the reached temperature, the variation amount in the rotation speed of the internal combustion engine and the variation amount in the intake air filling factor. For the same variation amount in the rotation speed of the internal combustion engine and the same variation amount in the intake air filling factor, a relationship between the plurality of set temperatures and the delay time of the oil jet start timing may be set such that the delay time of the oil jet start timing extends as the temperature decreases.

This is because it is estimated that the temperature of the piston increases as the coolant temperature decreases for the same variation amount in the rotation speed of the internal combustion engine and the same variation amount in the intake air filling factor. Therefore, the delay time is set such that the delay time extends as the coolant temperature decreases. Thus, the piston is not cooled more than necessary.

A second aspect of the invention provides a control method for an oil jet system for an internal combustion engine. The oil jet system includes an oil jet mechanism and an ECU. The oil jet mechanism is configured to direct oil jet toward a piston of the internal combustion engine. The control method includes: (d) controlling, by the ECU, the oil jet between an operated state and a stopped state; (e) in the stopped state of the oil jet, controlling, by the ECU, timing of an oil jet start operation on the basis of a coolant temperature of the internal combustion engine; and (f) in the operated state of the oil jet, controlling, by the ECU, timing of an oil jet stop operation on the basis of a lubricating oil temperature of the internal combustion engine.

According to the aspects of the invention, the timing of executing the oil jet start operation is controlled on the basis of the coolant temperature of the internal combustion engine, and the timing of executing the oil jet stop operation is controlled on the basis of the lubricating oil temperature of the internal combustion engine. Therefore, it is possible to determine the oil jet start timing and the oil jet stop timing that are suitable for an actual temperature of the piston, so it is possible to optimize these timings.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, an embodiment of the invention will be described with reference to the accompanying drawings. In the present embodiment, the case where the invention is applied to a multicylinder (for example, in-line four-cylinder) gasoline engine for an automobile will be described.

Oil Supply System for Engine

Figure 1:
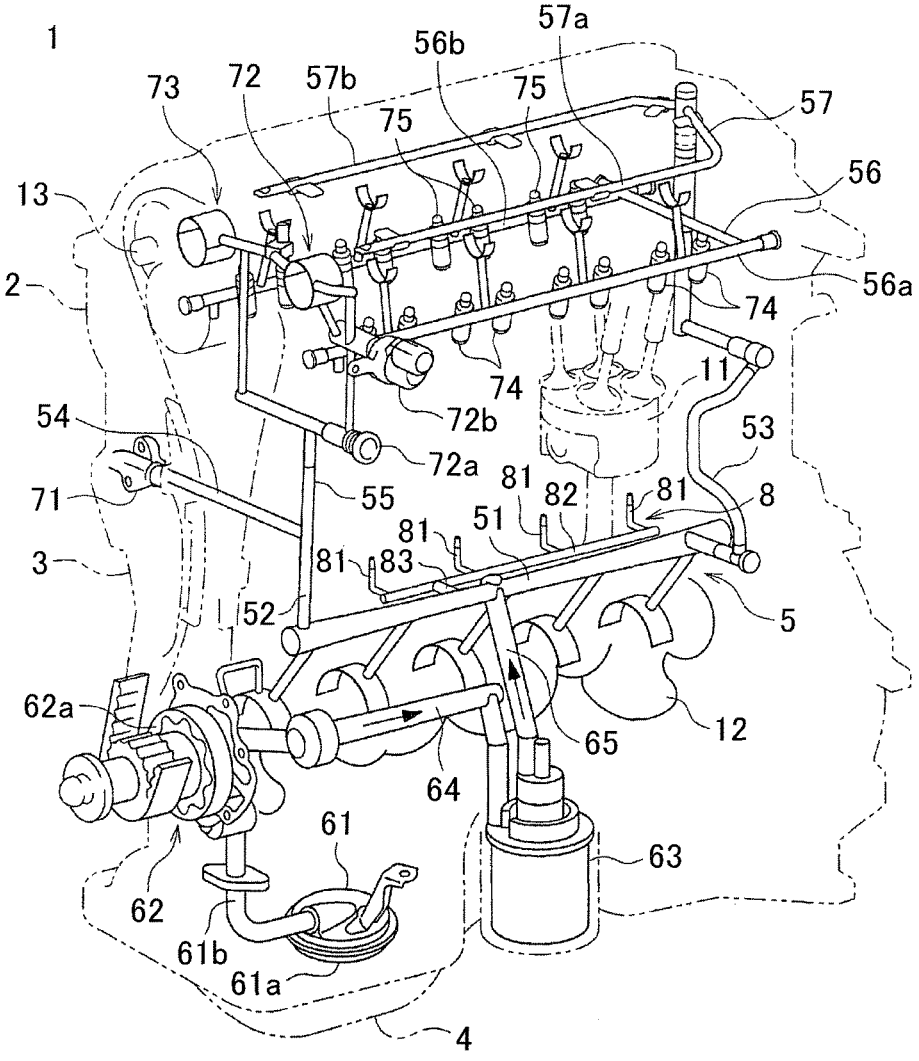
FIG. 1 is a view that shows the schematic configuration of an oil supply system of an engine according to an embodiment.

FIG. 1 is a view that shows the schematic configuration of an oil supply system for an engine (internal combustion engine) 1 according to the present embodiment. As shown in FIG. 1, the engine 1 includes a cylinder head 2, a cylinder block 3, an oil pan 4, and the oil supply system 5. The cylinder head 2 and the cylinder block 3 constitute an engine body. The oil pan 4 is connected to the lower end of the cylinder block 3. The oil supply system 5 circulates engine oil (hereinafter, which may be simply referred to as "oil") inside the engine 1 for internal lubrication, internal cooling, and the like, of the engine 1.

A plurality of lubricated members and cooled members, such as pistons 11, a crankshaft 12 and camshafts 13, are accommodated inside the engine 1.

Four cylinders are formed in the cylinder block 3. These cylinders are arranged in a cylinder array direction (horizontal direction in the drawing). The pistons 11 are respectively accommodated inside the cylinders so as to be reciprocally movable vertically in the drawing (see FIG. 2).

The oil supply system 5 is configured to draw oil stored in the oil pan 4, supply the oil to the lubricated members and cooled members and return the oil from these lubricated members and cooled members into the oil pan 4.

An oil strainer 61 is arranged near the bottom inside the oil pan 4. The oil strainer 61 has an inlet 61*a* for drawing oil stored inside the oil pan 4. The oil strainer 61 is connected to an oil pump 62 via a strainer flow passage 61*b*. The oil pump 62 is provided on the cylinder block 3.

The oil pump 62 is formed of a known rotary pump. A rotor 62*a* of the oil pump 62 is mechanically coupled to the crankshaft 12 so as to rotate together with the crankshaft 12. The oil pump 62 is connected to an oil inlet of an oil filter 63 via an oil transport passage 64. The oil filter 63 is provided outside the cylinder block 3. An oil outlet of the oil filter 63 is connected to an oil supply passage 65. The oil supply passage 65 is provided as an oil flow passage extending toward the lubricated members and the cooled members. The oil pump 62 may be an electric oil pump.

The specific configuration of the oil supply system 5 to which oil is supplied via the oil supply passage 65 will be described below.

The oil supply system 5 draws oil from the oil pan 4 via the oil strainer 61. The oil supply system 5 utilizes the oil as lubricating oil by supplying the oil to the lubricated members with the oil pump 62, utilizes the oil as cooling oil by supplying the oil to the cooled members, such as the pistons 11, or utilizes the oil as hydraulic oil by supplying the oil to hydraulically operating devices.

Specifically, oil fed under pressure from the oil pump 62 passes through the oil filter 63 and is then delivered to a main oil hole (main gallery) 51 extending in the cylinder array direction. Oil passages 52, 53 respectively communicate with one end and the other end of the main oil hole 51. The oil passages 52, 53 extend upward over the range from the cylinder block 3 to the cylinder head 2.

The oil passage 52 that communicates with the one end (left side in FIG. 1) of the main oil hole 51 is further branched off into a chain tensioner-side passage 54 and a variable valve timing (VVT)-side passage 55.

Oil supplied to the chain tensioner-side passage 54 is utilized as hydraulic oil for a chain tensioner 71. On the other hand, oil supplied to the VVT-side passage 55 passes through an oil filter 72*a* for an oil control valve (OCV), and is utilized as hydraulic oil for an OCV 72*b* for a VVT and variable valve timing mechanisms 72, 73.

On the other hand, the oil passage 53 that communicates with the other end (right side in FIG. 1) of the main oil hole 51 is branched off into a lash adjuster-side passage 56 and a shower pipe-side passage 57.

The lash adjuster-side passage 56 is further branched off into an intake-side passage 56*a* and an exhaust-side passage 56*b*. Oil supplied to the intake-side passage 56*a* is utilized as hydraulic foil for intake-side lash adjusters 74. Oil supplied to the exhaust-side passage 56*b* is utilized as hydraulic oil for exhaust-side lash adjusters 75.

The shower pipe-side passage 57 is also branched off into an intake-side passage 57*a* and an exhaust-side passage 57*b*. Oil supplied to the intake-side passage 57*a* is sprayed toward cam lobes of the intake camshaft. Oil supplied to the exhaust-side passage 57*b* is sprayed toward cam lobes of the exhaust camshaft.

Oil Jet Mechanism

The oil supply system 5 includes an oil jet mechanism 8 for cooling the pistons 11. Hereinafter, the oil jet mechanism 8 will be described.

The oil jet mechanism 8 includes a plurality of (four in the present embodiment) piston jet nozzles 81, an oil supply passage 82, and an oil control valve (OCV) 83. The plurality of piston jet nozzles 81 are arranged in correspondence with the cylinders. The oil supply passage 82 is used to supply oil from the main oil hole 51 to the piston jet nozzles 81. The OCV 83 adjusts the amount of oil that is supplied to the piston jet nozzles 81 (switches between an oil supply state and an oil stopped state, and adjusts the amount of oil supplied).

Each of the piston jet nozzles 81 has an injection hole directed toward the back face of a corresponding one of the pistons 11. When oil is supplied from the oil supply passage 82 to each piston jet nozzle 81, the piston jet nozzle 81 injects oil toward the back face of the corresponding piston 11.

That is, when the OCV 83 is in an open state, oil in the main oil hole 51 passes through the oil supply passage 82, the oil is supplied to the piston jet nozzles 81 corresponding to the cylinders, and the oil is injected from these piston jet nozzles 81 toward the back faces of the corresponding pistons 11. The pistons 11 are cooled by the injected oil, so, for example, an excessive increase in in-cylinder temperature is suppressed. Thus, it is possible to prevent occurrence of knocking.

On the other hand, when the OCV 83 is in a closed state, supply of oil from the main oil hole 51 to the oil supply passage 82 is stopped, and injection of engine oil from the piston jet nozzles 81 is also stopped.

Configuration of Engine

Next, the configuration of the engine 1 and the arrangement structure of the oil jet mechanism 8 according to the present embodiment will be described.

Figure 2:
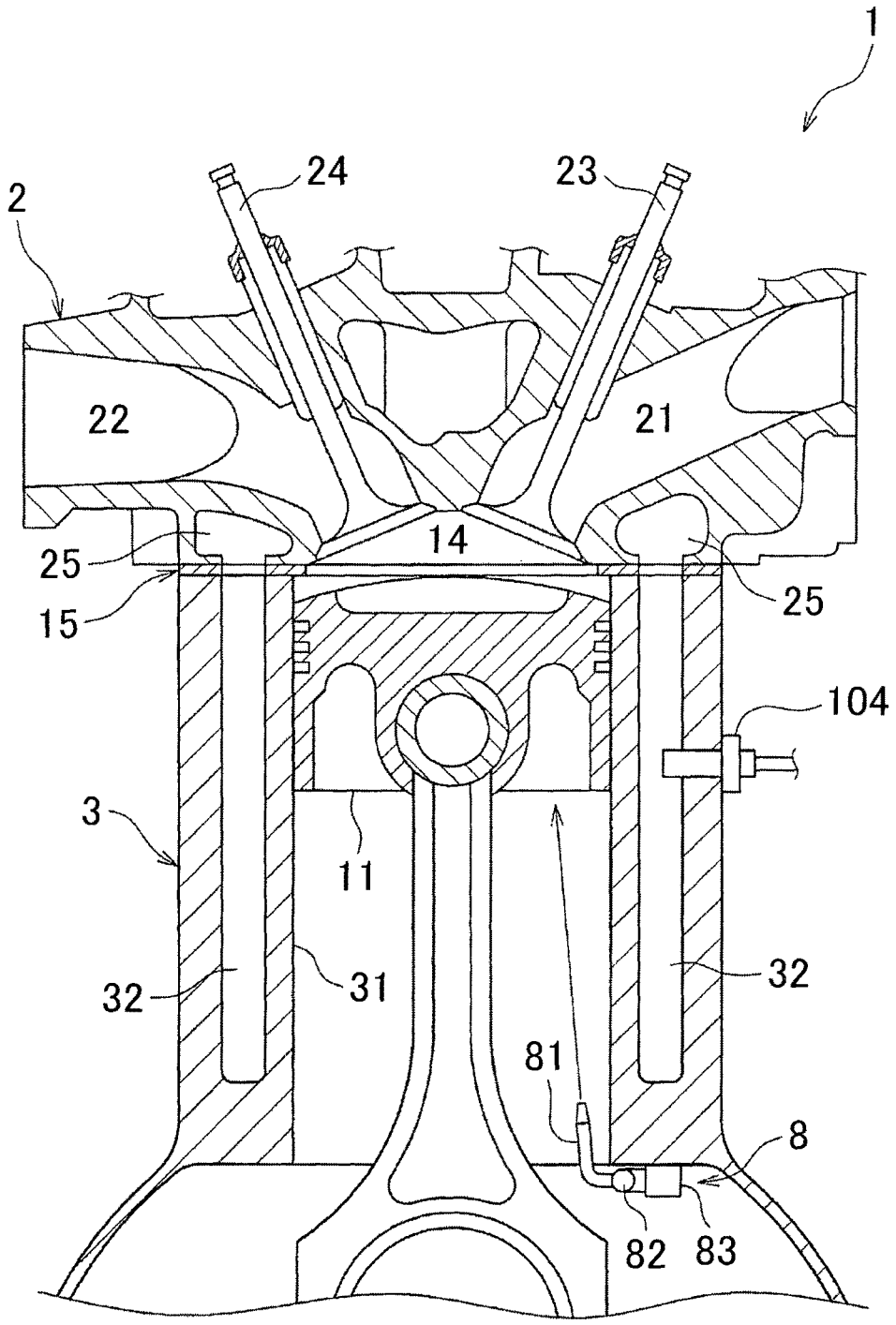
FIG. 2 is a cross-sectional view of the engine.

As shown in FIG. 2, in the engine 1 according to the present embodiment, a plurality of cylinder bores 31 are arranged in the longitudinal direction of the cylinder block 3 (only one cylinder is shown in FIG. 2). The pistons 11 are respectively accommodated in the cylinder bores 31.

Intake ports 21 and exhaust ports 22 are provided in the cylinder head 2. The intake ports 21 and the exhaust ports 22 respectively communicate with corresponding combustion chambers 14. Each of the intake ports 21 is opened or closed by driving a corresponding one of intake valves 23 with the intake camshaft 13, and the like. Each of the exhaust ports 22 is opened or closed by driving a corresponding one of exhaust valves 24 with the exhaust camshaft 13, and the like. The intake valves 23 and the exhaust valves 24 are provided on the cylinder head 2.

A cylinder block-side water jacket 32 is provided in a groove shape in the cylinder block 3 so as to surround the cylinder bores 31 and open toward a deck face.

A cylinder head-side water jacket 25 is open toward the cylinder block 3, and communicates with the cylinder block-side water jacket 32.

The cylinder block 3 and the cylinder head 2 are coupled to each other via a head gasket 15 by head bolts (not shown).

The oil jet mechanism 8 is arranged at the lower portion of the cylinder block 3, and the piston jet nozzle 81 is provided one by one for each cylinder. Each piston jet nozzle 81 extends horizontally from a portion connected to the oil supply passage 82, and then extends substantially vertically upward. Each piston jet nozzle 81 has the injection hole at its upper end. The injection hole is directed toward the back face of the corresponding piston 11. As described above, when the OCV 83 is in the open state, oil supplied from the oil supply passage 82 is injected from the piston jet nozzles 81 toward the back faces of the corresponding pistons 11 (see the arrow in FIG. 2), with the result that the pistons 11 are cooled.

As described above, this cooling of the pistons 11 is mainly intended to prevent occurrence of knocking in a combustion stroke of the engine 1. Therefore, basically, for example, during warm-up of the engine 1, there is a small request for cooling the pistons 11; whereas, after completion of warm-up of the engine 1 (particularly, a high load operation region or high rotation speed region after completion of warm-up), there is a large request for cooling the pistons 11. Therefore, for example, in a predetermined operation region after completion of warm-up of the engine 1, the OCV 83 becomes the released state. As a result, engine oil is supplied to the oil supply passage 82, and the engine oil is injected (an oil jet is directed) from each piston jet nozzle 81 toward the back face of the corresponding piston 11. The operation of switching between an operated state and stopped state of the oil jet will be described later. The configuration of the OCV 83 is known, so the description thereof is omitted here.

Control System of OCV

Figure 3:
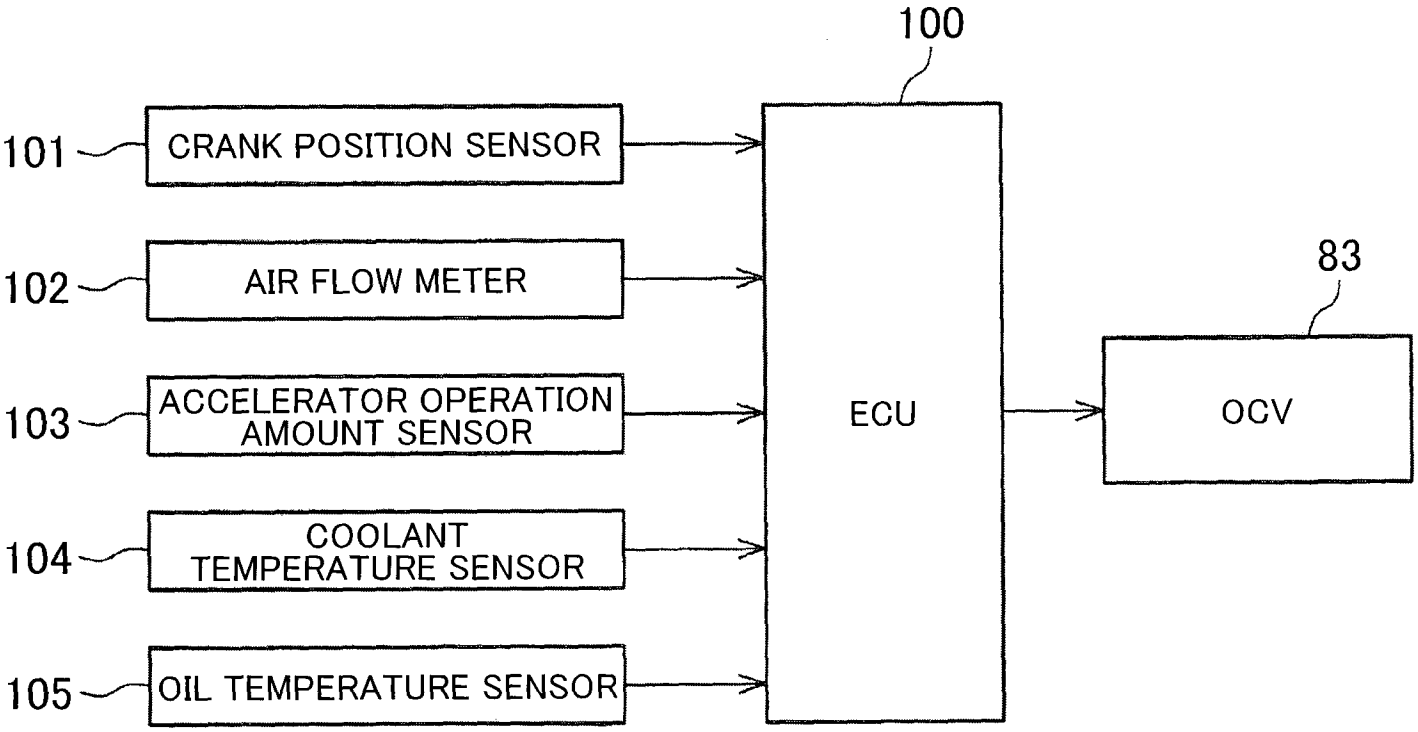
FIG. 3 is a block diagram that shows a control system of an OCV.

FIG. 3 is a block diagram that shows a control system associated with the OCV 83. The ECU 100 is an electronic control unit that executes, for example, operation control over the engine 1. The ECU 100 includes a central processing unit (CPU), a read only memory (ROM), a random access memory (RAM), a backup RAM, and the like.

The ROM stores various control programs, maps, and the like. The maps are consulted when those various control programs are executed. The CPU executes arithmetic processing on the basis of the various control programs and maps stored in the ROM. The RAM is a memory that temporarily stores results computed in the CPU, data input from sensors, and the like. The backup RAM is a nonvolatile memory that stores data, and the like, to be saved, for example, at the time of stop of the engine 1.

In the control system associated with the OCV 83, a plurality of sensors are connected to the ECU 100. Specifically, a crank position sensor 101, an air flow meter 102, an accelerator operation amount sensor 103, a coolant temperature sensor 104, an oil temperature sensor 105, and the like, are connected to the ECU 100. The crank position sensor 101 transmits a pulse signal each time the crankshaft 12 that is an output shaft of the engine 1 rotates by a predetermined angle. The air flow meter 102 detects an intake air amount. The accelerator operation amount sensor 103 detects an accelerator operation amount that is a depression amount of an accelerator pedal. The coolant temperature sensor 104 detects the temperature of engine coolant. The oil temperature sensor 105 detects the temperature of engine oil. Signals from these sensors 101 to 105 are input to the ECU 100.

Specifically, the coolant temperature sensor 104 is arranged at the side of the cylinder block 3 (see FIG. 2), and detects the temperature of coolant flowing through the inside of the cylinder block-side water jacket 32. The oil temperature sensor 105 is arranged in the oil pan 4, and detects the temperature of engine oil stored at the bottom of the oil pan 4. The oil temperature sensor 105 may be arranged in the main oil hole 51 or the oil supply passage 82 in order to increase the detection accuracy of the temperature of engine oil that is injected from the piston jet nozzles 81.

Other than the above-described sensors, a throttle opening degree sensor, a shift position sensor, a wheel speed sensor, a brake pedal sensor, an intake air temperature sensor, an intake air pressure sensor, an A/F sensor, an $O_2$ sensor, a cam position sensor, and the like, (all are not shown) are connected to the ECU 100 as known sensors, and signals from these sensors are also input to the ECU 100.

The ECU 100 executes not only control over various actuators (a throttle motor, injectors, igniters, and the like) of the engine 1 but also open/close control (oil jet control) over the OCV 83 on the basis of the signals output from the various sensors. The open/close control over the OCV 83 will be described later. The ECU 100 and the oil jet mechanism 8 constitute an oil jet system according to the invention.

Oil Jet Control

Next, oil jet control that is characterized control of the present embodiment will be described.

As described above, in the existing technique, when the oil jet stop timing is not appropriately obtained, the oil jet stop timing is late and the oil jet operation period is long, oil is easy to leak via the clearance between the cylinder inner wall surface and each piston into the corresponding combustion chamber. When a leakage of oil into the combustion chamber occurs, there is a concern that the engine oil may form a deposit on the cylinder inner wall surface or the piston top face. This deposit causes pre-ignition at the time when the cylinder inner wall surface or the piston top face has reached a predetermined temperature or higher while the engine is operated at a low rotation high load. On the other hand, when the oil jet stop timing is early and the oil jet operation period is short, it is not possible to sufficiently cool the piston, so there is a possibility that an excessive increase in the temperature of the piston arises. When the oil jet start timing is earlier than optimal timing, the piston is cooled more than necessary; whereas, when the oil jet start timing is later than the optimal timing, an excessive increase in the temperature of the piston arises.

In consideration of these points, in the present embodiment, in order to appropriately obtain the timing of switching the oil jet between the operated state and the stopped state, in the stopped state of the oil jet, the timing of the oil jet start operation is controlled on the basis of the temperature of coolant (hereinafter, which may be simply referred to as "coolant temperature") of the engine 1. In the operated state of the oil jet, the timing of the oil jet stop operation is controlled on the basis of the temperature of engine oil (hereinafter, which may be simply referred to as "oil temperature"). Specifically, in the stopped state of the oil jet, the oil jet start operation is executed at the time when the coolant temperature of the engine 1 has increased to a predetermined temperature, whereas, in the operated state of the oil jet, the oil jet stop operation is executed at the time when the oil temperature of the engine 1 has decreased to a predetermined temperature. In this oil jet stop operation, a delay time until the oil jet is stopped is changed in response to a variation amount in engine rotation speed and a variation amount in intake air filling factor.

Figure 4:
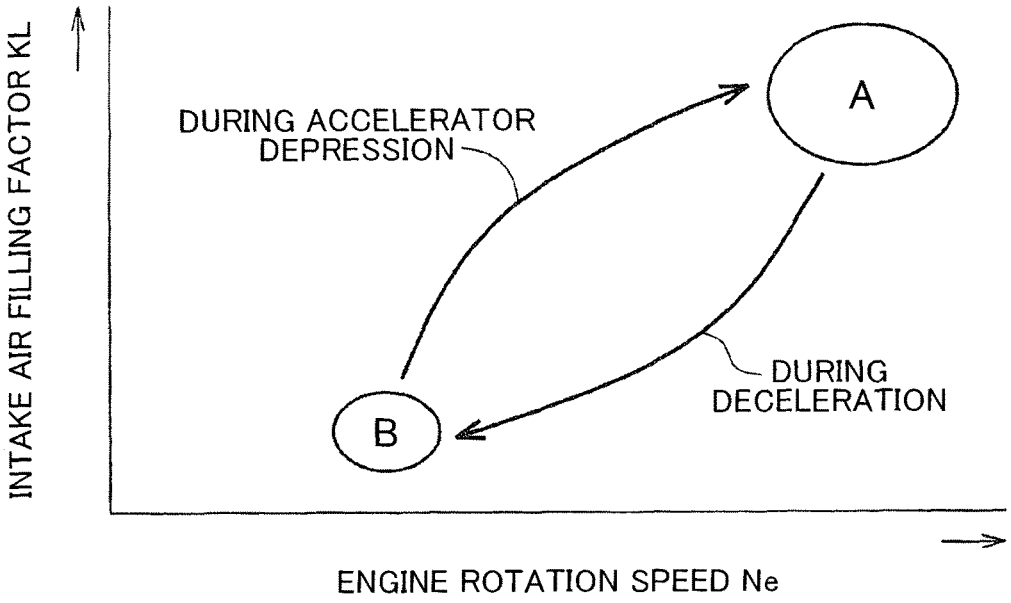
FIG. 4 is a graph for illustrating a shift in an operation region of the engine.

The reason why the delay time is set will be described below. Even when the oil temperature of the engine 1 has decreased to the predetermined temperature, there is a possibility that an actual temperature of each piston is still high. For example, it is assumed that the engine 1 shifts from the high rotation high load operation region into the low rotation low load operation region as a result of, for example, braking of the vehicle (deceleration of the vehicle). FIG. 4 is a graph that shows a shift in the operation region of the engine 1 based on the engine rotation speed and the intake air filling factor. When the operation region shifts from the high rotation high load operation region indicated by A in the graph to the low rotation low load operation region indicated by B in the graph (see "during deceleration" in the graph), there is a possibility that the actual temperature of each piston is still high because of the fact that the engine 1 has been operated at a high rotation high load until just before even when the oil temperature of the engine 1 has decreased to the predetermined temperature. At this time, if the oil jet is stopped at the timing at which the oil temperature of the engine 1 has decreased to the predetermined temperature, there is a possibility that the temperature of each piston is kept high. Therefore, in the present embodiment, even when the oil temperature has decreased to the predetermined temperature but when it is estimated that the temperature of each piston is high, the delay time until the oil jet is stopped is provided, and necessary minimum cooling of the pistons 11 is continued. In the present embodiment, at the time when the oil temperature has decreased to the predetermined temperature, the delay time is set on the basis of a variation amount in engine rotation speed and a variation amount in intake air filling factor during a predetermined period just before then. Specifically, as the variation amount in engine rotation speed increases or as the variation amount in intake air filling factor increases, the delay time is set so as to extend.

Figure 5:
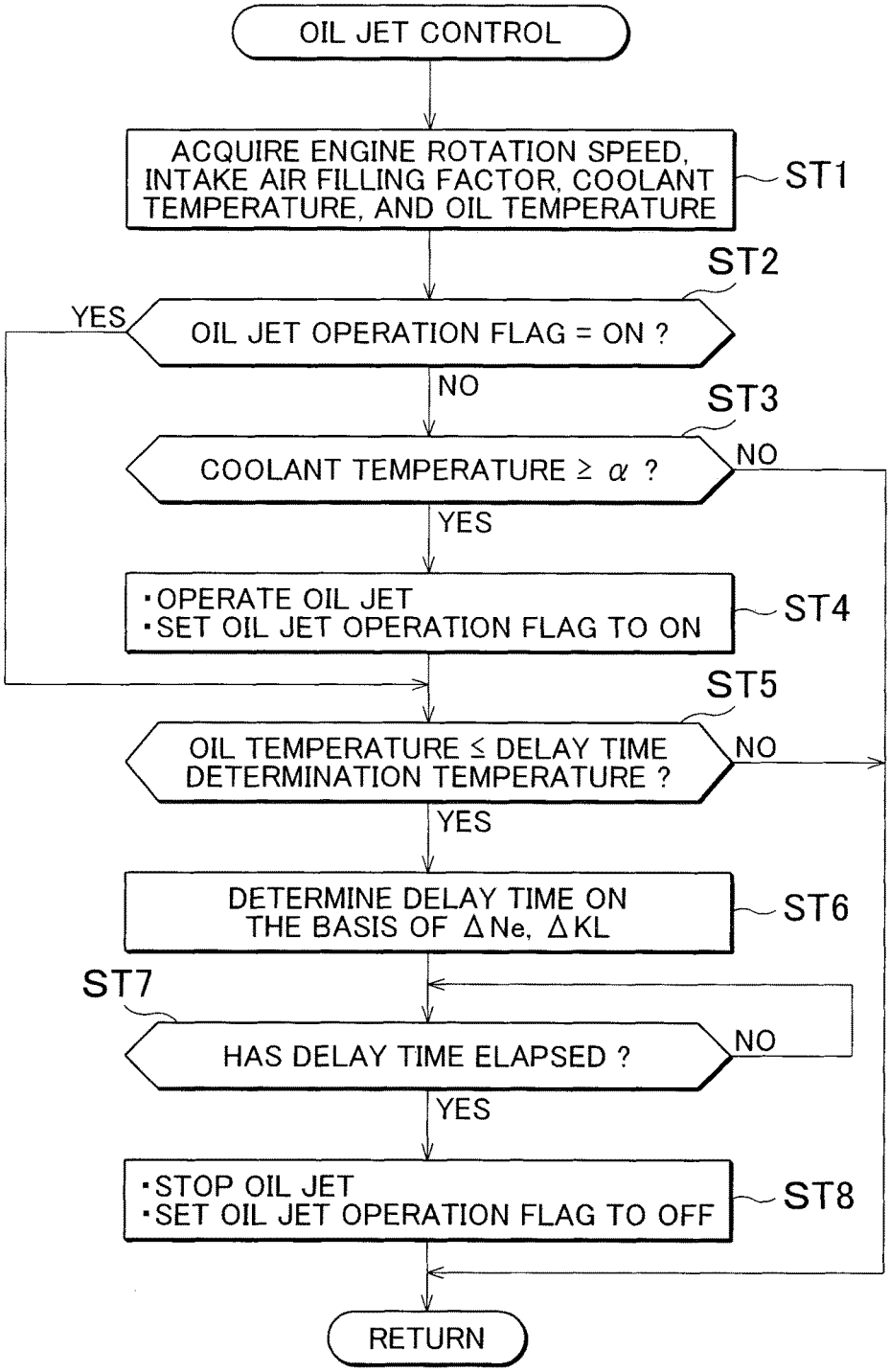
FIG. 5 is a flowchart that shows the procedure of oil jet control.

Hereinafter, the procedure of oil jet control will be specifically described with reference to the flowchart of FIG. 5. The flowchart shown in FIG. 5 is executed at intervals of several milliseconds or each time the crankshaft 12 rotates by a predetermined rotation angle after the engine 1 starts up.

Initially, in step ST1, an engine rotation speed Ne, an intake air filling factor KL, a coolant temperature THw and an oil temperature THo are acquired. The engine rotation speed Ne is calculated on the basis of a signal output from the crank position sensor 101. The intake air filling factor KL is calculated on the basis of an intake air amount, the engine rotation speed, and the like. The intake air amount is detected by the air flow meter 102. The intake air filling factor may be calculated on the basis of an intake air pressure that is detected by the intake air pressure sensor. The coolant temperature THw is detected by the coolant temperature sensor 104. The oil temperature THo is detected by the oil temperature sensor 105.

After various pieces of information are acquired in this way, the process proceeds to step ST2, and it is determined whether an oil jet operation flag prestored in the ECU 100 is in an on state. The oil jet operation flag is set to the on state when an oil jet operation condition (described later) is satisfied and the oil jet is being operated. The oil jet operation flag is set to an off state when an oil jet stop condition (described later) is satisfied and the oil jet is stopped.

During engine start-up (for example, during warm-up operation in cold start-up), the oil jet operation condition is not satisfied, and the oil jet operation flag is set to the off state. In this case, negative determination is made in step ST2, and the process proceeds to step ST3.

In step ST3, it is determined whether the coolant temperature detected by the coolant temperature sensor 104 is higher than or equal to a predetermined temperature $\alpha$. The predetermined temperature $\alpha$ is set by an experiment or simulation in advance as a coolant temperature corresponding to a situation that the temperature of each piston has increased to a temperature at which cooling of the pistons 11 is required. The predetermined temperature $\alpha$ is set to, for example, 80° C. The predetermined temperature $\alpha$ is not limited to this value, and may be set as needed.

When the coolant temperature is lower than the predetermined temperature $\alpha$ and negative determination is made in step ST3, the process returns on the assumption that it is not required to cool the pistons 11 by the oil jet (it is not required to start the oil jet) because the coolant temperature is relatively low, that is, the temperature of each piston 11 is relatively low. That is, the closed state of the OCV 83 is continued.

On the other hand, when the coolant temperature is higher than or equal to the predetermined temperature $\alpha$ and affirmative determination is made in step ST3, the process proceeds to step ST4. In step ST4, on the assumption that it is required to cool the pistons 11 by the oil jet because the coolant temperature is relatively high, that is, the temperature of each piston 11 is relatively high, the oil jet is operated by opening the OCV 83, and the oil jet operation flag is set to the on state. Thus, cooling of the pistons 11 by the oil jet is started.

After that, the process proceeds to step ST5, and it is determined whether the oil temperature detected by the oil temperature sensor 105 has decreased to a predetermined delay time determination temperature. The delay time determination temperature is prescribed as a temperature at which it is required to set the delay time until a stop of the oil jet in stopping the oil jet. Specifically, a plurality of temperatures are set as the delay time determination temperature. When the oil temperature has decreased to one of these plurality of delay time determination temperatures, affirmative determination is made in step ST5.

Specifically, as an example of the delay time determination temperature, "100° C.", "90° C.", "80° C.", and the like, are set in advance, and affirmative determination is made in step ST5 at the timing at which the oil temperature has decreased and reached any one of the temperatures. For example, when the oil temperature has decreased from a state over "100° C." to "100° C.", when the oil temperature has decreased from a value (for example, "98° C.") between "100° C." and "90° C." to "90° C.", or when the oil temperature has decreased from a value (for example, "88° C.") between "90° C." and "80° C." to "80° C.", affirmative determination is made in step ST5.

When the oil temperature has not decreased to any one of the delay time determination temperatures yet, negative determination is made in step ST5, and the process returns on the assumption that it is not required to stop the oil jet yet (it is not required to set the delay time for stopping the oil jet). In this case, because the oil jet operation flag is already set to the on state (the oil jet operation flag is set to the on state in step ST4), in the next routine after the return, affirmative determination is made in step ST2, and it is determined in step ST5 whether the oil temperature has decreased to any one of the delay time determination temperatures. That is, the operations of step ST1, step ST2, step ST5 are repeated until the oil temperature decreases to any one of the delay time determination temperatures.

When the oil temperature has decreased to the delay time determination temperature and affirmative determination is made in step ST5, the process proceeds to step ST6; and the delay time for stopping the oil jet is determined. The delay time is determined in accordance with a delay time setting map (described later) on the basis of a variation amount $\Delta$Ne in engine rotation speed and a variation amount $\Delta$KL in intake air filling factor during a predetermined period (for example, during a period of three seconds) just before the oil temperature decreases to the delay time determination temperature.

Figure 6A:
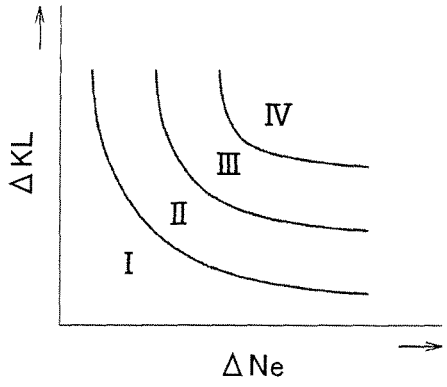
FIG. 6A to FIG. 6C are graphs that show delay time setting maps.
Figure 6B:
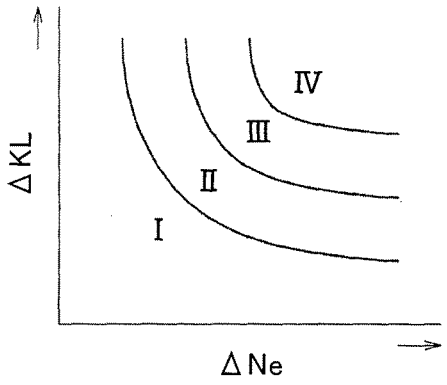
Figure 6C:
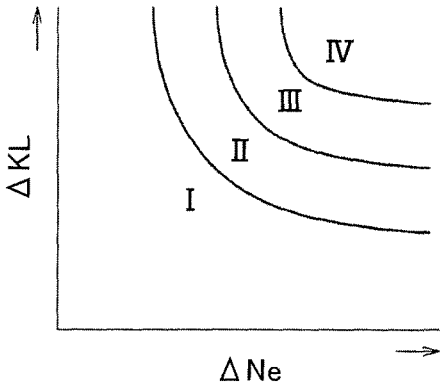

FIG. 6A to FIG. 6C are graphs that show delay time setting maps stored in the ROM. FIG. 6A to FIG. 6C respectively have different target oil temperatures. For example, FIG. 6A shows the delay time setting map in the case where the oil temperature is 100° C. FIG. 6B shows the delay time setting map in the case where the oil temperature is 90° C. FIG. 6C shows the delay time setting map in the case where the oil temperature is 80° C. That is, when the oil temperature has decreased from a state over "100° C." to "100° C." as described above and affirmative determination is made in step ST5, the delay time setting map shown in FIG. 6A is extracted from the ROM. When the oil temperature has decreased from a value between "100° C." and "90° C." to "90° C." and affirmative determination is made in step ST5, the delay time setting map shown in FIG. 6B is extracted from the ROM. When the oil temperature has decreased from a value between "90° C." and "80° C." to "80° C." and affirmative determination is made in step ST5, the delay time setting map shown in FIG. 6C is extracted from the ROM. A delay time is determined by applying the variation $\Delta$Ne in engine rotation speed and the variation $\Delta$KL in intake air filling factor to the extracted delay time setting map.

Here, the case where the three maps for three target temperatures are stored in the ROM as the delay time setting maps is described; however, the number of maps is not limited to three. Four or more maps for four or more target temperatures may be stored in the ROM.

Each of these delay time setting maps is used to determine the delay time on the basis of a variation amount ΔNe in engine rotation speed and a variation amount ΔKL in intake air filling factor as described above. As regions for setting the delay time, shown in each of FIG. 6A to FIG. 6C, the delay time extends in order of Region I, Region II, Region III, Region IV. For example, the delay time is set to "0 sec" in Region I, the delay time is set to "1 sec" in Region II, the delay time is set to "2 sec" in Region III, and the delay time is set to "3 sec" in Region IV. The delay time is not limited to these values, and may be set as needed.

The delay time setting maps are set such that the region in which the delay time is set to extend is expanded for the map of which the target oil temperature is higher. That is, boundary lines between adjacent regions are set to a side at which the variation amount ΔNe in engine rotation speed is small and a side at which the variation amount ΔKL in intake air filling factor is small as the target oil temperature of the map increases. Specifically, when Region IV (region in which the delay time is set to "3 sec") of each of the maps is compared with each other, Region IV expands in order of the delay time setting map (map of which the target oil temperature is "80° C.") shown in FIG. 6C, the delay time setting map (map of which the target oil temperature is "90° C.") shown in FIG. 6B, and the delay time setting map (map of which the target oil temperature is "100° C.") shown in FIG. 6A. As the target oil temperature increases, the delay time is set so as to extend for the same variation amount in engine rotation speed and the same variation amount in intake air filling factor. This corresponds to that "for the same variation amount in rotation speed of an internal combustion engine and the same variation amount in intake air filling factor, a relationship between the plurality of set temperatures and the delay time of the oil jet stop timing is set such that the delay time of the oil jet stop timing extends as the temperature increases" according to the invention. The reason why the delay time is set in this way is to reliably reduce the temperature of each piston by extending the delay time until a stop of the oil jet because it is estimated that the temperature of each piston increases as the oil temperature increases.

In this way, after the delay time is determined on the basis of the delay time setting map extracted in response to the oil temperature, the process proceeds to step ST7, and it is determined whether the delay time has elapsed.

When the delay time has elapsed and affirmative determination is made in step ST7, the process proceeds to step ST8, the oil jet is stopped by closing the OCV 83, and the oil jet operation flag is set to the off state. Thus, cooling of the pistons 11 by the oil jet is stopped.

Because the delay time determined as described above is relatively short (3 sec at the maximum in the above-described case), if the oil temperature further decreases before a lapse of the once determined delay time, there is a low possibility that the oil temperature reaches the low-temperature-side delay time determination temperature. That is, in the above-described case, there is a low possibility that the oil temperature decreases by 10° C. or more before the delay time elapses. For example, there is a low possibility that the oil temperature decreases to "90° C." before a lapse of the delay time determined on the basis of the delay time setting map (shown in FIG. 6A) of which the target oil temperature is "100° C.". Therefore, the once determined delay time is kept at a certain value until the delay time elapses and the oil jet is stopped.

Figure 7:
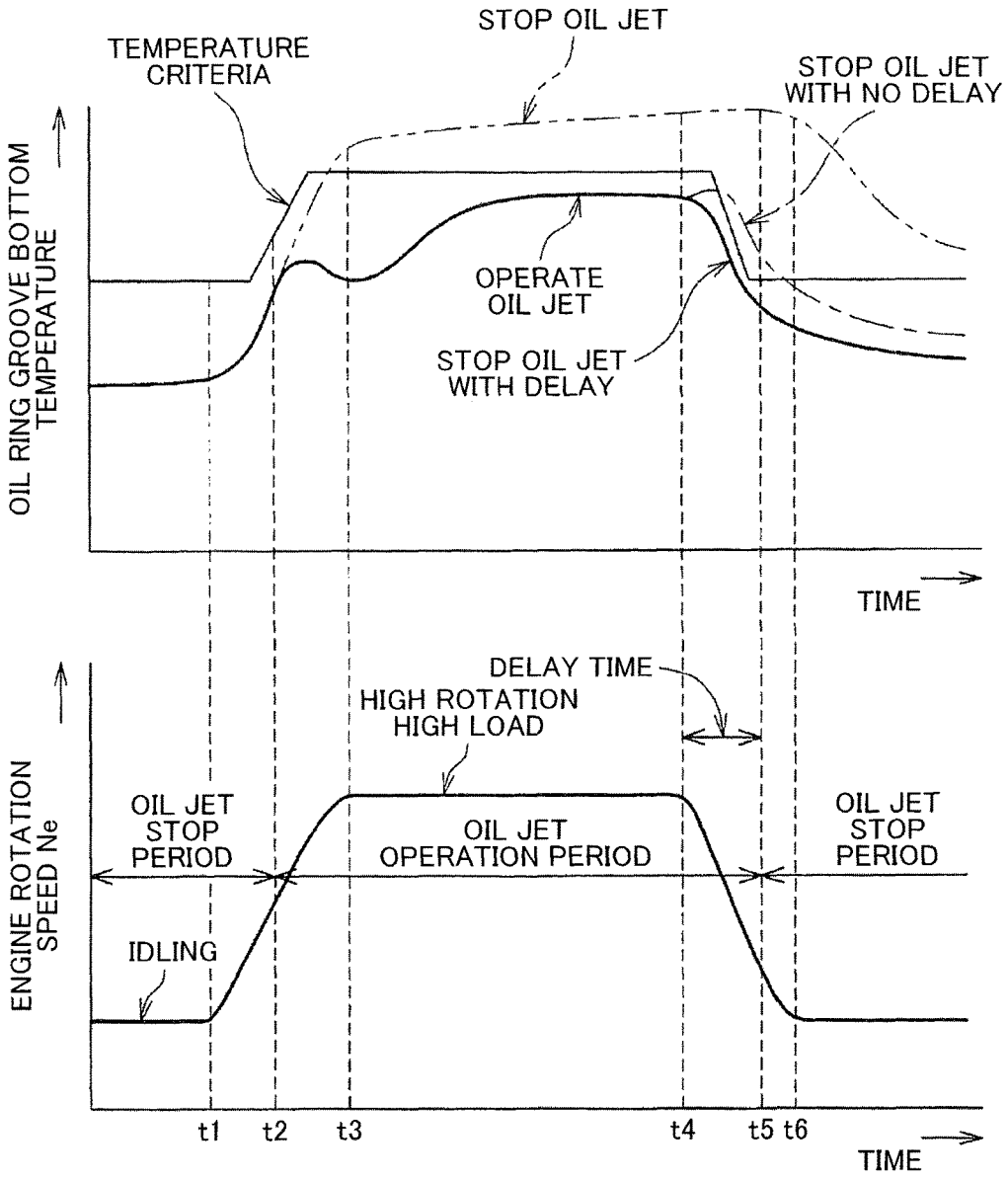
FIG. 7 is a timing chart that shows changes in oil ring groove bottom temperature with a change in engine rotation speed in each of the case where an oil jet is operated and the case where the oil jet is not operated.

FIG. 7 is a timing chart that shows changes in oil ring groove bottom temperature with a change in engine rotation speed in each of the case where the oil jet is operated and the case where the oil jet is not operated. Here, the temperature of each piston 11 is replaced with the oil ring groove bottom temperature.

When the engine rotation speed and the engine load increase at timing t1 in the timing chart from an idling operation state of the engine 1, the oil ring groove bottom temperature (piston temperature) also increases accordingly.

The coolant temperature exceeds the predetermined temperature α at timing t2 in the timing chart, and the oil jet is started accordingly (step ST3 and step ST4 in the flowchart of FIG. 5). With the start of the oil jet, an increase in the oil ring groove bottom temperature (the temperature of each piston) is suppressed. A waveform indicated by the alternate long and two-short dashed line in the timing chart shows changes in oil ring groove bottom temperature in the case where the oil jet is not operated. In this case, the oil ring groove bottom temperature exceeds temperature criteria.

A period from timing t3 to timing t4 after the oil jet is started at timing t2 in the timing chart is a period during which the engine 1 is operated at a high rotation high load. During this period as, well, because the pistons 11 are cooled by the oil jet, the oil ring groove bottom temperature does not exceed the temperature criteria.

The engine rotation speed and the engine load decrease from timing t4 in the timing chart. After that, when the oil temperature has decreased to the delay time determination temperature (when affirmative determination is made in step ST5 in the flowchart of FIG. 5), the oil jet is continued for only the delay time determined in response to the amount of decrease in engine rotation speed and the amount of decrease in engine load (step ST7 in the flowchart of FIG. 5, the time from timing t4 to timing t5 is the delay time). With continuation of the oil jet as a result of providing the delay time, cooling of the pistons 11 is continued, with the result that the oil ring groove bottom temperature does not exceed the temperature criteria (see a temperature change in the case where there is a delay in stopping the oil jet in the timing chart).

In contrast, when the delay time is not provided, as indicated by the alternate long and short dashed line in the timing chart (see a temperature change in the case where there is no delay in stopping the oil jet in the timing chart), the oil ring groove bottom temperature exceeds the temperature criteria.

The oil jet is stopped at timing t5 at which the delay time has elapsed, and, after that, the engine operating state returns to the idling operation state of the engine 1 from timing t6.

In this way, the oil jet start timing is set on the basis of the coolant temperature and the oil jet stop timing is set on the basis of the oil temperature, and the delay time until the oil jet is stopped is set on the basis of the variation amount in engine rotation speed and the variation amount in intake air filling factor. Thus, it is possible to appropriately obtain the oil jet operation period while the oil ring groove bottom temperature (the temperature of each piston) does not exceed the temperature criteria. Therefore, it is possible to prevent inconveniences (occurrence of LSPI, an excessive increase in the temperature of each piston, and the like) due to inappropriate oil jet start timing or inappropriate oil jet stop timing.

Alternative Embodiment

Next, an alternative embodiment will be described. In the above-described embodiment, the delay time is set in stopping the oil jet. In the alternative embodiment, a delay time is also set in starting the oil jet (a delay time until the oil jet is started). That is, the delay time until the oil jet is started at the time when the coolant temperature becomes higher than or equal to a predetermined temperature is set in advance, and the oil jet is started after a lapse of the delay time.

The reason why the delay time until the oil jet is started is set will be described below. Even when the coolant temperature of the engine 1 increases to the predetermined temperature, there is a possibility that an actual temperature of each piston is still low. For example, it is assumed that the engine 1 shifts into the high rotation high load operation region during warm-up operation of the engine 1. When the operation region shifts from the low rotation low load operation region indicated by B in the graph in FIG. 4 to the high rotation high load operation region indicated by A in the graph (see "during accelerator depression" in the graph), there is a possibility that the actual temperature of each piston is still low because of the fact that the engine 1 has been operated at a low rotation low load until just before even when the coolant temperature of the engine 1 has increased to the predetermined temperature. At this time, if the oil jet is started at the timing at which the coolant temperature of the engine 1 has increased to the predetermined temperature, there is a possibility that the pistons are cooled more than necessary. Therefore, in the present alternative embodiment, even when the coolant temperature has increased to the predetermined temperature, but when it is estimated that the temperature of each piston is low, the delay time until the oil jet is started is provided, and cooling of the pistons 11 more than necessary is suppressed. In the present alternative embodiment as well, at the time when the coolant temperature has increased to the predetermined temperature, the delay time is set on the basis of a variation amount in engine rotation speed and a variation amount in intake air filling factor for a predetermined period just before then. Specifically, as the variation amount in engine rotation speed increases or as the variation amount in intake air filling factor increases, the delay time is set so as to extend.

Figure 8:
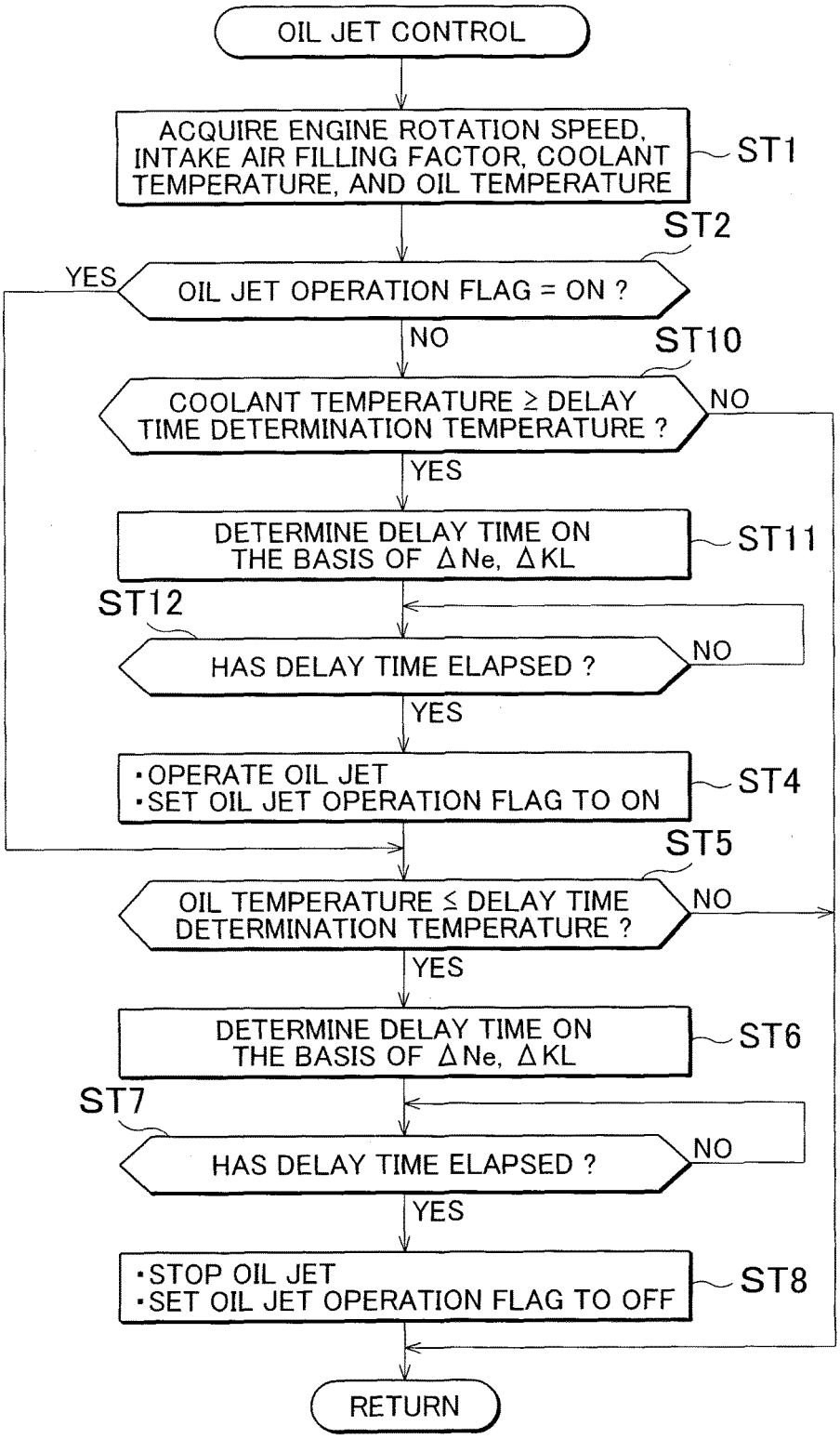
FIG. 8 is a flowchart that shows the procedure of oil jet control according to an alternative embodiment.

FIG. 8 is a flowchart that shows the procedure of oil jet control according to the present alternative embodiment. The operations of step ST1, step ST2, step ST4 to step ST8 in the flowchart are similar to the operations of step ST1, step ST2, step ST4 to step ST8 shown in FIG. 5 in the above-described embodiment, so the description is omitted.

When the oil jet operation flag is set to the off state and negative determination is made in step ST2, the process proceeds to step ST10. In step ST10, it is determined whether the coolant temperature detected by the coolant temperature sensor 104 has increased to a predetermined delay time determination temperature. The delay time determination temperature is prescribed as a temperature at which it is required to set the delay time until a start of the oil jet in starting the oil jet. Specifically, a plurality of temperatures are set as the delay time determination temperature. When the coolant temperature has increased to one of these plurality of delay time determination temperatures, affirmative determination is made in step ST10. Setting of the delay time determination temperature is similarly carried out to that of the above-described embodiment (however, temperature values are different), so the description is omitted.

When the coolant temperature has not increased to any one of the delay time determination temperatures, negative determination is made in step ST10, and the process returns on the assumption that it is not required to start the oil jet yet (it is not required to set the delay time for starting the oil jet). In this case, because the oil jet operation flag is set to the off state, in the next routine after the return, negative determination is made in step ST2, and it is determined in step ST10 whether the coolant temperature has increased to any one of the delay time determination temperatures. That is, the operations of step ST1, step ST2, step ST10 are repeated until the coolant temperature increases to any one of the delay time determination temperatures.

When the coolant temperature has increased to the delay time-determination temperature and affirmative determination is made in step ST10, the process proceeds to step ST11, and the delay time for starting the oil jet is determined. The delay time is determined in accordance with a delay time setting map (not shown) on the basis of a variation amount $\Delta Ne$ in engine rotation speed and a variation amount $\Delta KL$ in intake air filling factor for a predetermined period (for example, for a period of three seconds) just before the coolant temperature increases to the delay time determination temperature. Determination of the delay time is similarly carried out to that of the above-described embodiment, so the description is omitted.

In this way, in the present alternative embodiment, the plurality of delay time determination temperatures for starting the oil jet are set in advance. When the coolant temperature has increased and reached one of the delay time determination temperatures, the delay time is determined on the basis of a variation amount $\Delta Ne$ in engine rotation speed and a variation amount $\Delta KL$ in intake air filling factor. In the present alternative embodiment, in this operation, as the target coolant temperature decreases, the delay time is set so as to extend for the same variation amount in engine rotation speed and the same variation amount in intake air filling factor. This corresponds to that "for the same variation amount in rotation speed of an internal combustion engine and the same variation amount in intake air filling factor, a relationship between the plurality of set temperatures and the delay time of the oil jet start timing is set such that the delay time of the oil jet start timing extends as the temperature decreases" according to the invention. The reason why the delay time is set in this way is not to cool the pistons more than necessary by extending the delay time until a start of the oil jet because it is estimated that the temperature of each piston decreases as the coolant temperature decreases.

After the delay time is determined on the basis of the delay time setting map, the process proceeds to step ST12, and it is determined whether the delay time has elapsed.

When the delay time has elapsed and affirmative determination is made in step ST12, the process proceeds to step ST4, the oil jet is operated by opening the OCV 83, and the oil jet operation flag is set to the on state. Thus, cooling of the pistons 11 by the oil jet is started.

The other operations are similar to those of the above-described embodiment.

According to the present alternative embodiment, by setting the delay time until a start of the oil jet on the basis of a variation amount in engine rotation speed and a variation amount in intake air filling factor, it is possible to optimize the oil jet start timing, so it is possible to prevent cooling of the pistons more than necessary and an excessive increase in the temperature of each piston.

Other Embodiments

The above-described embodiment and alternative embodiment describe the case where the invention is applied to the oil jet system for an in-line four-cylinder gasoline engine for an automobile. The invention is not limited to application of the invention to the oil jet system for an in-line four-cylinder gasoline engine for an automobile. The invention may also be applied to an oil jet system for an engine that is applied to a device other than an automobile. The number of cylinders or the type of engine (V type, horizontally-Opposed type, or the like) is not specifically limited. The invention may also be applied to an oil jet system for a diesel engine.

In the above-described embodiment and alternative embodiment, the case where the invention is applied to a conventional vehicle (vehicle on which only an engine is mounted as a driving force source) is described; however, the invention may be applied to a hybrid vehicle (vehicle on which an engine and an electric motor are mounted as driving force sources).

In the above-described embodiment and alternative embodiment, the oil jet mechanism 8 includes the OCV 83 that is able to adjust its opening degree. The invention is not limited to the configuration that the oil jet mechanism 8 includes the OCV 83. The oil jet mechanism 8 may include an OSV that is switched between an open state and a closed state.

The invention is applicable to control for switching an oil jet between an operated state and a stopped state in an engine including an oil jet system.

What is claimed is:

1. An oil jet system for an internal combustion engine, the oil jet system comprising:

an oil jet mechanism that directs an oil jet toward a piston of the internal combustion engine; and an ECU that:

controls the oil jet between an operated state and a stopped state;

in the stopped state of the oil jet, controls timing of an oil jet start operation based on a coolant temperature of the internal combustion engine and determines a delay time of oil jet stop timing in response to a rotation speed of the internal combustion engine and an intake air filling factor; and in the operated state of the oil jet, controls timing of an oil jet stop operation based on a lubricating oil temperature of the internal combustion engine.

2. The oil jet system according to claim 1, wherein the ECU is configured to, in the stopped state of the oil jet, execute the oil jet start operation at the time when the coolant temperature of the internal combustion engine has increased to a first predetermined temperature, and the ECU is configured to, in the operated state of the oil jet, execute the oil jet stop operation at the time when the lubricating oil temperature of the internal combustion engine has decreased to a second predetermined temperature.

3. The oil jet system according to claim 1, wherein the ECU is configured to set oil jet stop timing in executing the oil jet stop operation in accordance with an estimated temperature of the piston.

4. The oil jet system according to claim 2, wherein the ECU is configured to, when the lubricating oil temperature of the internal combustion engine has decreased to the second predetermined temperature, set the delay time of the oil jet stop timing such that the delay time of the oil jet stop timing extends as at least one of a variation amount in the rotation speed of the internal combustion engine during a predetermined period or a variation amount in the intake air filling factor during the predetermined period increases.

5. The oil jet system according to claim 1, wherein a plurality of temperatures are set as the lubricating oil temperature for starting the oil jet stop operation, the delay time of the oil jet stop timing is defined in response to a variation amount in the rotation speed of the internal combustion engine and a variation amount in the intake air filling factor for each temperature, the ECU is configured to, when the lubricating oil temperature has decreased and reached any one of a plurality of set temperatures, set the delay time of the oil jet stop timing in response to all of the reached temperature, the variation amount in the rotation speed of the internal combustion engine and the variation amount in the intake air filling factor, and for a same variation amount in the rotation speed of the internal combustion engine and a same variation amount in the intake air filling factor, a relationship between the plurality of set temperatures and the delay time of the oil jet stop timing is set such that the delay time of the oil jet stop timing extends as the temperature increases.

6. The oil jet system according to claim 1, wherein the ECU is configured to, in the oil jet start operation, determine a delay time of the oil jet start timing in response to a rotation speed of the internal combustion engine and an intake air filling factor.

7. The oil jet system according to claim 6, wherein the ECU is configured to, when the coolant temperature of the internal combustion engine has increased to a first predetermined temperature, set the delay time of the oil jet start timing such that the delay time of the oil jet start timing extends as at least one of a variation amount in the rotation speed of the internal combustion engine during a predetermined period or a variation amount in the intake air filling factor during the predetermined period increases.

8. The oil jet system according to claim 6, wherein a plurality of temperatures are set as the coolant temperature for starting the oil jet start operation, the delay time of the oil jet start timing is defined in response to a variation amount in the rotation speed of the internal combustion engine and a variation amount in the intake air filling factor for each temperature, the ECU is configured to, when the coolant temperature has increased and reached any one of a plurality of set temperatures, set the delay time of the oil jet start timing in response to all of the reached temperature, the variation amount in the rotation speed of the internal combustion engine and the variation amount in the intake air filling factor, and for a same variation amount in the rotation speed of the internal combustion engine and a same variation amount in the intake air filling factor, a relationship between the plurality of set temperatures and the delay time of the oil jet start timing is set such that the delay time of the oil jet start timing extends as the temperature decreases.

9. A control method for an oil jet system for an internal combustion engine, the oil jet system including an oil jet mechanism and an ECU, the oil jet mechanism being configured to direct an oil jet toward a piston of the internal combustion engine, the control method comprising:

controlling, by the ECU, the oil jet between an operated state and a stopped state;

in the stopped state of the oil jet, controlling, by the ECU, timing of an oil jet start operation based on a coolant temperature of the internal combustion engine and determine a delay time of oil jet stop timing in response to a rotation speed of the internal combustion engine and an intake air filling factor; and in the operated state of the oil jet, controlling, by the ECU, timing of an oil jet stop operation based on a lubricating oil temperature of the internal combustion engine.

10. An oil jet system for an internal combustion engine, the oil jet system comprising:

an oil jet mechanism that directs an oil jet toward a piston of the internal combustion engine; and an ECU that:

controls the oil jet between an operated state and a stopped state;

in the stopped state of the oil jet, controls timing of an oil jet start operation based on a coolant temperature of the internal combustion engine; and in the operated state of the oil jet, controls timing of an oil jet stop operation based on a lubricating oil temperature of the internal combustion engine and determine a delay time of the oil jet start timing in response to a rotation speed of the internal combustion engine and an intake air filling factor.

11. The oil jet system according to claim 10, wherein the ECU is configured to, in the stopped state of the oil jet, execute the oil jet start operation at the time when the coolant temperature of the internal combustion engine has increased to a first predetermined temperature, and the ECU is configured to, in the operated state of the oil jet, execute the oil jet stop operation at the time when the lubricating oil temperature of the internal combustion engine has decreased to a second predetermined temperature.

12. The oil jet system according to claim 11, wherein the ECU is configured to, in the oil jet stop operation, determine a delay time of oil jet stop timing in response to a rotation speed of the internal combustion engine and an intake air filling factor; and the ECU is configured to, when the lubricating oil temperature of the internal combustion engine has decreased to the second predetermined temperature, set the delay time of the oil jet stop timing such that the delay time of the oil jet stop timing extends as at least one of a variation amount in the rotation speed of the internal combustion engine during a predetermined period or a variation amount in the intake air filling factor during the predetermined period increases.

13. The oil jet system according to claim 10, wherein the ECU is configured to set oil jet stop timing in executing the oil jet stop operation in accordance with an estimated temperature of the piston.

14. The oil jet system according to claim 10, wherein the ECU is configured to, in the oil jet stop operation, determine a delay time of oil jet stop timing in response to a rotation speed of the internal combustion engine and an intake air filling factor; and a plurality of temperatures are set as the lubricating oil temperature for starting the oil jet stop operation, the delay time of the oil jet stop timing is defined in response to a variation amount in the rotation speed of the internal combustion engine and a variation amount in the intake air filling factor for each temperature, the ECU is configured to, when the lubricating oil temperature has decreased and reached any one of a plurality of set temperatures, set the delay time of the oil jet stop timing in response to all of the reached temperature, the variation amount in the rotation speed of the internal combustion engine and the variation amount in the intake air filling factor, and for a same variation amount in the rotation speed of the internal combustion engine and a same variation amount in the intake air filling factor, a relationship between the plurality of set temperatures and the delay time of the oil jet stop timing is set such that the delay time of the oil jet stop timing extends as the temperature increases.

15. The oil jet system according to claim 10, wherein the ECU is configured to, when the coolant temperature of the internal combustion engine has increased to a first predetermined temperature, set the delay time of the oil jet start timing such that the delay time of the oil jet start timing extends as at least one of a variation amount in the rotation speed of the internal combustion engine during a predetermined period or a variation amount in the intake air filling factor during the predetermined period increases.

16. The oil jet system according to claim 10, wherein a plurality of temperatures are set as the coolant temperature for starting the oil jet start operation, the delay time of the oil jet start timing is defined in response to a variation amount in the rotation speed of the internal combustion engine and a variation amount in the intake air filling factor for each temperature, the ECU is configured to, when the coolant temperature has increased and reached any one of a plurality of set temperatures, set the delay time of the oil jet start timing in response to all of the reached temperature, the variation amount in the rotation speed of the internal combustion engine and the variation amount in the intake air filling factor, and for a same variation amount in the rotation speed of the internal combustion engine and a same variation amount in the intake air filling factor, a relationship between the plurality of set temperatures and the delay time of the oil jet start timing is set such that the delay time of the oil jet start timing extends as the temperature decreases.

* * * * *